US010825622B2

(12) United States Patent
Oh et al.

(10) Patent No.: US 10,825,622 B2
(45) Date of Patent: Nov. 3, 2020

(54) REMOTE SPEAKER MICROPHONE WITH TOGGLE SWITCH LEVER

(71) Applicant: MOTOROLA SOLUTIONS, INC., Chicago, IL (US)

(72) Inventors: Zhen Xiang Oh, Penang (MY); Mohd Hizami Abdul Hamid, Penang (MY); Kuang Eng Lim, Penang (MY); Wei Hung Tai, Perlis (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 16/361,716

(22) Filed: Mar. 22, 2019

(65) Prior Publication Data

US 2020/0303142 A1 Sep. 24, 2020

(51) Int. Cl.

| | |
|---|---|
| ***H01H 23/06*** | (2006.01) |
| ***H04R 1/02*** | (2006.01) |
| ***H01H 23/14*** | (2006.01) |
| ***H04R 1/08*** | (2006.01) |

(52) U.S. Cl.

CPC ..... *H01H 23/06* (2013.01); *H01H 23/143* (2013.01); *H04R 1/02* (2013.01); *H04R 1/08* (2013.01); *H04R 2400/01* (2013.01)

(58) Field of Classification Search

CPC ..... H01H 23/06; H01H 23/143; H04R 1/02; H04R 1/08; H04R 2400/01

USPC ..... 200/339

See application file for complete search history.

(56) References Cited

U.S. PATENT DOCUMENTS

| | | | | | |
|---|---|---|---|---|---|
| 2,109,378 | A * | 2/1938 | Bentley | H01H 23/02 | 200/450 |
| 2,440,943 | A | 5/1948 | Gonsett et al. | | |
| 3,614,346 | A * | 10/1971 | Gudaitis | H01H 19/635 | 200/16 D |
| 4,090,379 | A | 5/1978 | Lehner | | |
| 4,370,528 | A * | 1/1983 | Aschenbach | H01H 23/065 | 200/302.3 |
| 4,789,766 | A * | 12/1988 | Krause | H01H 23/06 | 200/302.3 |
| 5,338,909 | A | 8/1994 | Stanley et al. | | |
| 6,162,999 | A * | 12/2000 | Ishikawa | H01H 25/041 | 200/339 |

(Continued)

FOREIGN PATENT DOCUMENTS

GB 730387 A 5/1955

OTHER PUBLICATIONS

International Search Report and Written Opinion for Application No. PCT/US2020/023782 dated Aug. 3, 2020 (19 pages).

*Primary Examiner* — Edwin A. Leon
*Assistant Examiner* — Lheiren Mae A Caroc
(74) *Attorney, Agent, or Firm* — Michael Best and Friedrich, LLP

(57) ABSTRACT

A remote speaker microphone includes a housing having a bezel defining an outer surface. The remote speaker microphone further includes a toggle switch lever that rocks back and forth relative to the bezel. The remote speaker microphone further includes a bezel opening through which the toggle switch lever extends at the outer surface. The bezel and the toggle switch lever define a predetermined gap within the bezel opening and within which the toggle switch lever rocks. The bezel, the bezel opening, and the toggle switch lever together form an ice crushing region in response to rocking the toggle switch lever.

20 Claims, 9 Drawing Sheets

(56) References Cited

U.S. PATENT DOCUMENTS

| | | | |
|---|---|---|---|
| 7,964,812 | B1 | 6/2011 | Schwinn |
| 9,018,553 | B1 | 4/2015 | Arnold et al. |

* cited by examiner

REMOTE SPEAKER MICROPHONE WITH TOGGLE SWITCH LEVER

BACKGROUND OF THE INVENTION

Remote speaker microphones commonly include a toggle switch lever along an exterior of the remote speaker microphone that is rocked back and forth by a user to control a function of the remote speaker microphone.

Although toggle switch levers are commonly used on remote speaker microphones, in cold weather ice may form alongside or underneath portions of the toggle switch lever, making the toggle switch lever difficult or impossible to rock back and forth. Accordingly, there is a need for an improved remote speaker microphone.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
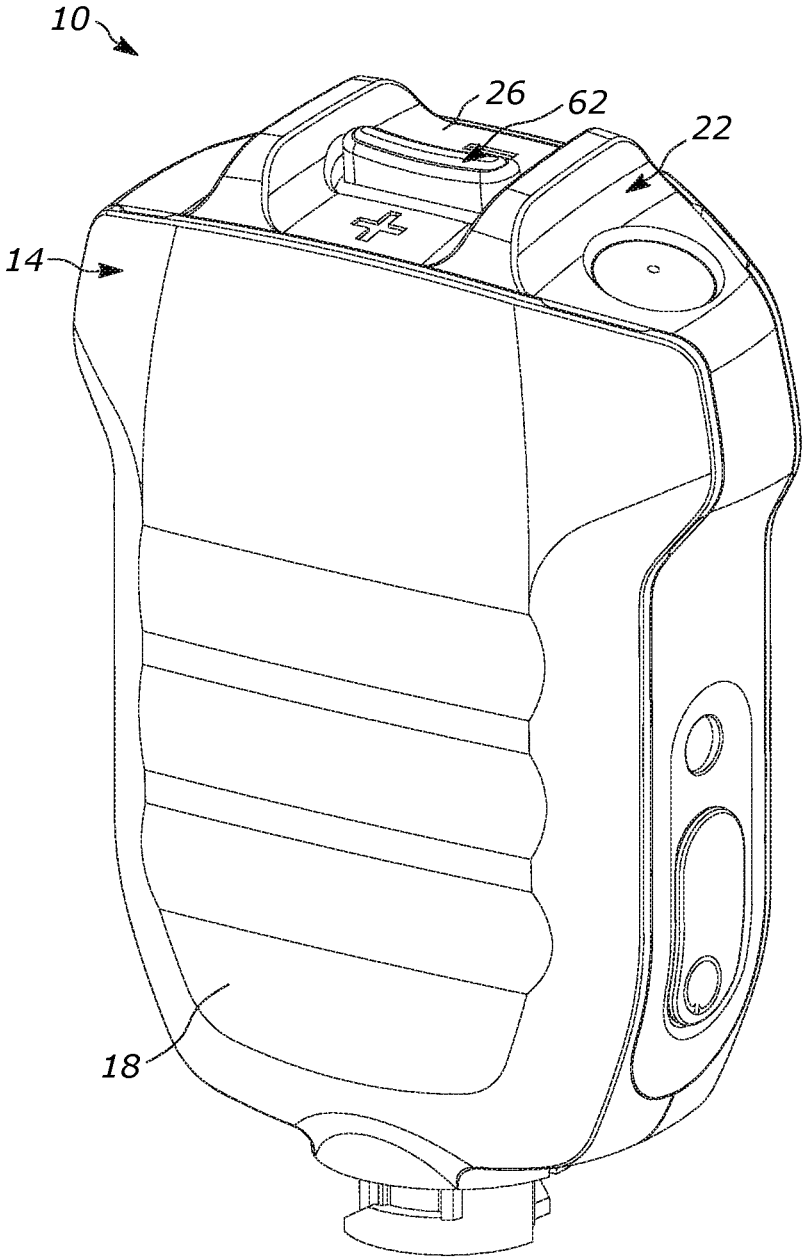
FIG. 1 is a front perspective view of a remote speaker microphone in accordance with one embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Briefly, there is provided herein an improved remote speaker microphone including a toggle switch lever that provides an ice crushing feature. A remote speaker microphone is provided, in accordance with an embodiment, having a housing having a bezel defining an outer surface. The remote speaker microphone further includes a toggle switch lever that rocks back and forth relative to the bezel. The remote speaker microphone further includes a bezel opening through which the toggle switch lever extends at the outer surface. The bezel and the toggle switch lever define a predetermined gap within the bezel opening and within which the toggle switch lever rocks. The bezel, the bezel opening, and the toggle switch lever together form an ice crushing region in response to rocking the toggle switch lever.

Figure 2:
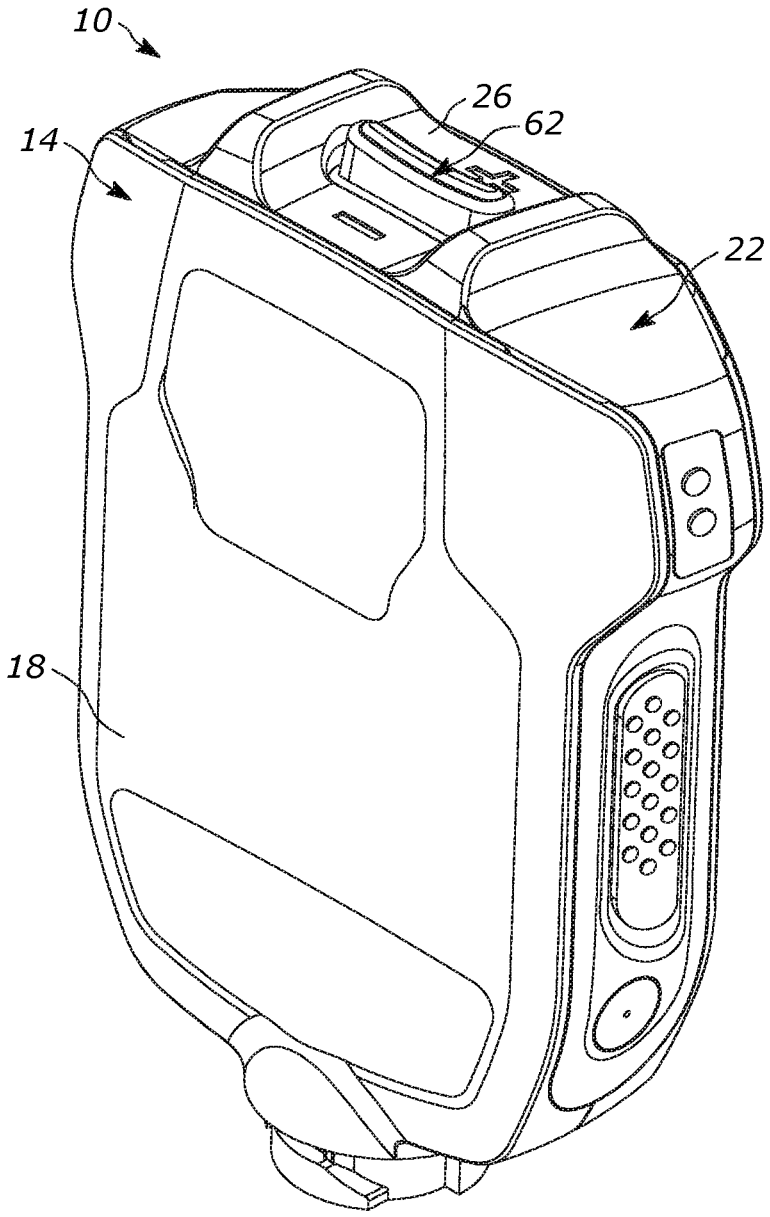
FIG. 2 is a rear perspective view of the remote speaker microphone.

FIGS. 1-10 illustrate one example of a remote speaker microphone 10. FIGS. 1 and 2 show isometric front and back views of the remote speaker microphone 10. The remote speaker microphone 10 may operate as an accessory to a portable communication device, such as a portable radio. The remote speaker microphone 10 may be worn on or about a shoulder, may be body wearable, and/or may be part of a public safety communication device. The remote speaker microphone 10 includes a housing 14, which may be made for example from rigid plastic. The housing 14 includes a main body 18, and a bezel 22 coupled to the main body 18. The bezel 22 defines an outer surface 26 along a top of the remote speaker microphone 10. As will be described herein, the bezel 22, a bezel opening, and a toggle switch lever 62 together form an ice crushing region.

Figure 3:
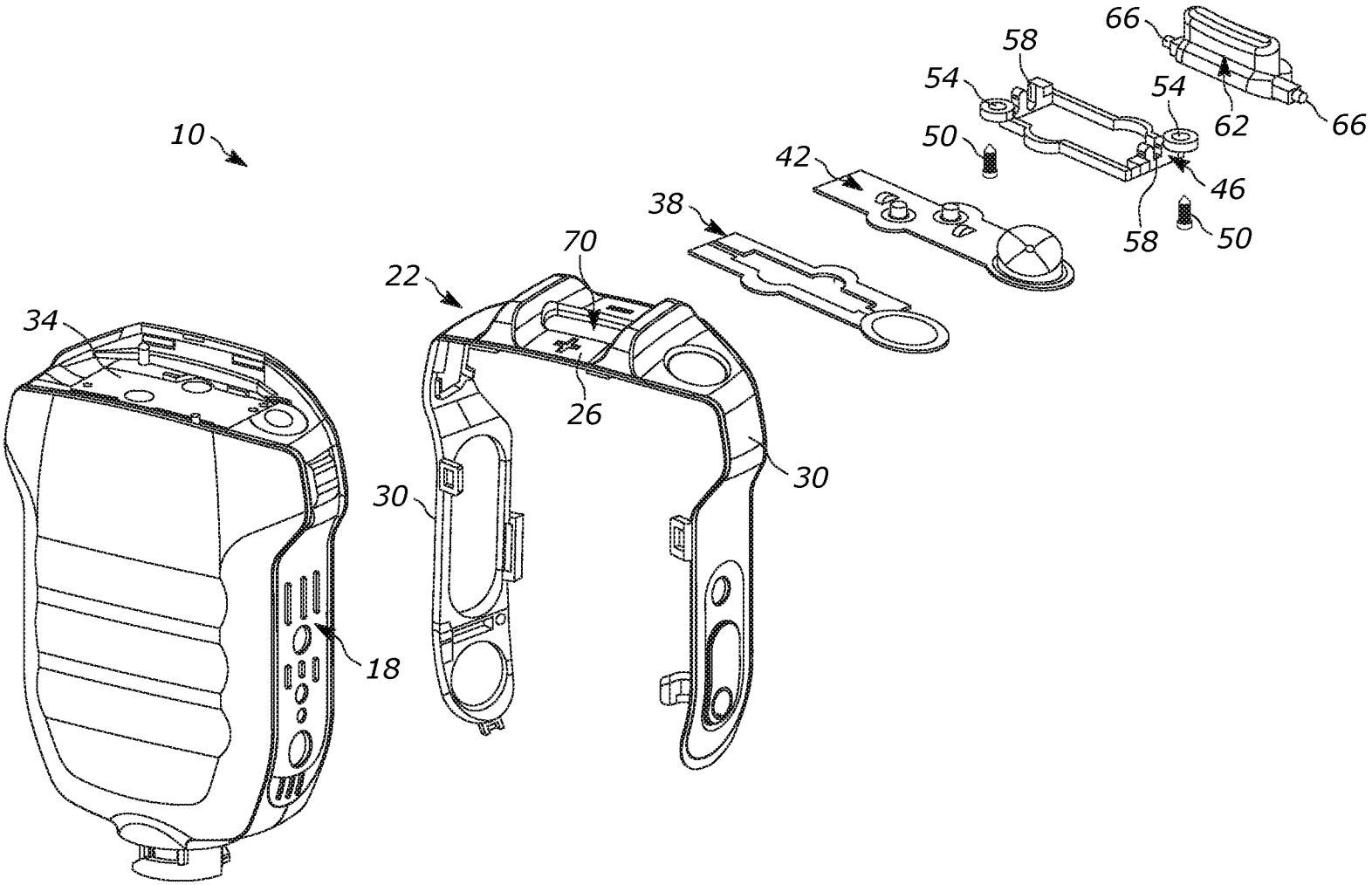
FIG. 3 is an exploded view of the remote speaker microphone.

As illustrated in FIG. 3, the bezel 22 may have a generally U-shaped profile with legs 30 extending down along sides of the remote speaker microphone 10, although other embodiments may include profiles other than that illustrated.

With continued reference to FIG. 3, the remote speaker microphone 10 may additionally include a flex element 34 (for example a printed circuit board) disposed along a top of the main body 18 of the housing 14. During assembly a layer of adhesive 38 may be applied along a perimeter of the flex element 34, and a keypad 42 (for example, made of rubber) may be placed over the top of the layer of adhesive 38. The adhesive 38 inhibits or prevents water from contacting the flex element 34 or other interior components of the remote speaker microphone 10.

With continued reference to FIG. 3, the remote speaker microphone 10 may additionally include a toggle support element 46. The toggle support element 46 includes bearing regions 58 along opposite sides of the toggle support element 46.

With continued reference to FIG. 3, the remote speaker microphone 10 further includes a toggle switch lever 62. The toggle switch lever 62 may include trunnions 66 (for example pivot pins) on opposite sides of the toggle switch lever 62 that are sized and shaped so as to snap into the bearing regions 58 of the toggle support element 46 (for example via a generally tight fit) and rotate within the bearing regions 58. The toggle support element 46 assembled with the toggle switch lever 62 may be fixed in place relative to the bezel 22 via fasteners 50 (for example screws) that extend through fastener openings 54 on the toggle support element 46.

With continued reference to FIG. 3, the bezel 22 assembled with the toggle support element 46 and toggle switch lever 62 fits over the keypad 42. Once assembled, the toggle switch lever 62 may be rocked back and forth relative to the bezel 22, such that a portion of the toggle switch lever 62 presses against the keypad 42 in one or more regions when the toggle switch lever 62 is rocked, thereby completing or interrupting an electrical connection on the flex element 34 to control a feature (for example volume control) of the remote speaker microphone 10.

In some embodiments the bezel 22, the toggle switch lever 62, the toggle support element 46, and the keypad 42 are each part of a top module of the remote speaker microphone 10. The top module may be a water-sealed sub-assembly of the remote speaker microphone 10. For example, the toggle switch lever 62 may be exposed to an environment outside of the remote speaker microphone 10, whereas the flex element 34 is sealed off from the outside environment.

Figure 4:
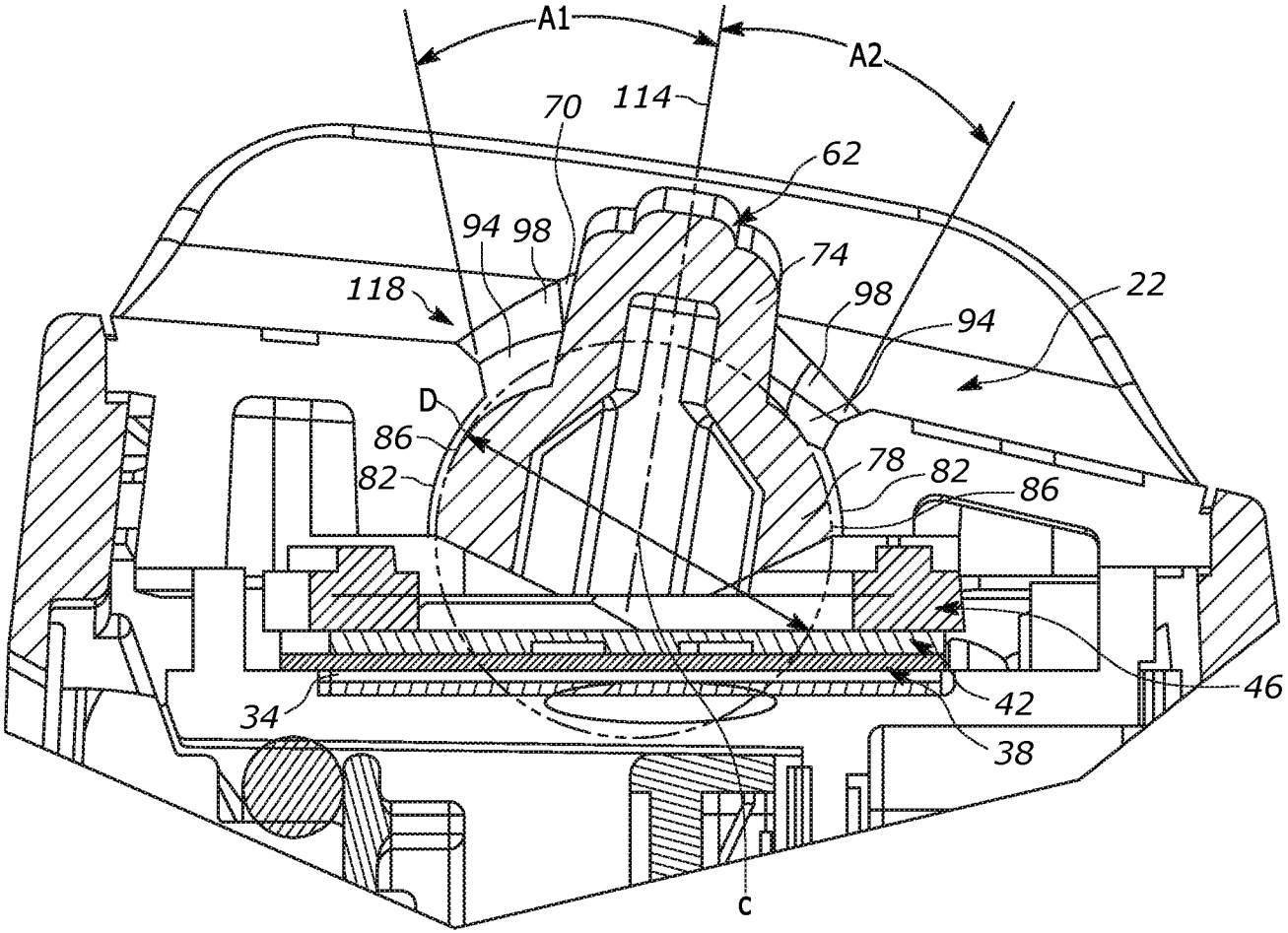
FIG. 4 is a cross-sectional view of a portion of the remote speaker microphone.

With reference to FIG. 3, in the illustrated embodiment the toggle switch lever 62 extends through a bezel opening 70 of the bezel 22 at the outer surface 26. The bezel opening 70 is a through opening that extends through the bezel 22. As illustrated in FIG. 4, the toggle switch lever 62 includes a first portion 74 disposed outside of and exterior to the bezel opening 70. During use, the first portion 74 is physically contacted (for example, by a user's finger) and rocked back and forth. The toggle switch lever 62 further includes a second portion 78 disposed within the bezel opening 70. The second portion 78 rocks back and forth with the first portion 74, and may be integrally formed as one piece with the first portion 74.

Figure 5:
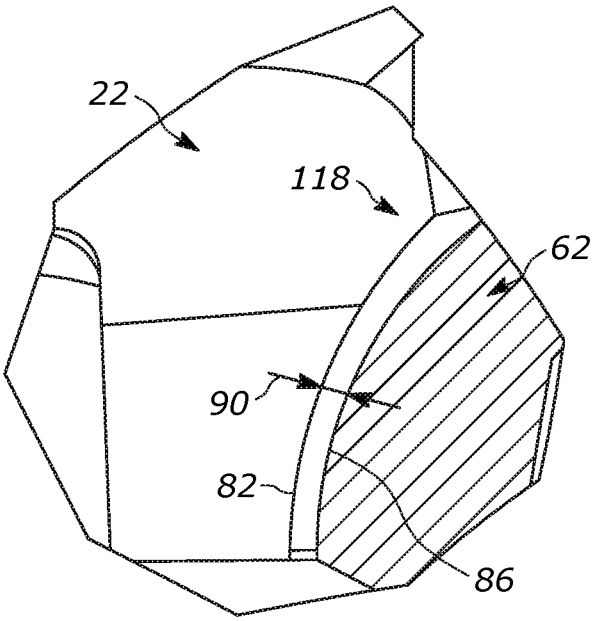
FIG. 5 is an enlarged view of a portion of the cross-sectional view of FIG. 4.
Figure 6:
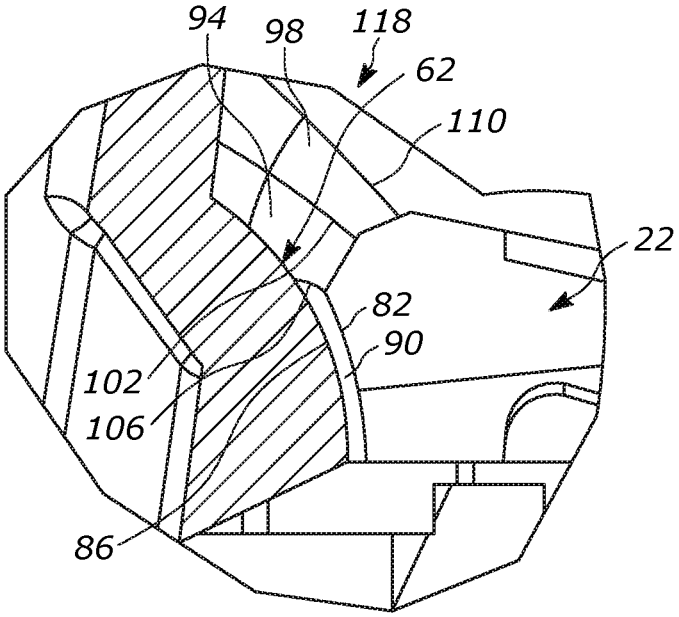
FIG. 6 is an enlarged view of another portion of the cross-sectional view of FIG. 4

With reference to FIGS. 4-6, the bezel 22 includes concave surfaces 82 on opposite sides of the bezel 22 that define a portion of the bezel opening 70. The concave surfaces 82 may extend entirely around the bezel opening 70 and thus form one continuous concave surface. The second portion 78 of the toggle switch lever 62 includes corresponding convex surfaces 86 on opposite sides of the toggle switch lever 62. The convex surfaces 86 may extend entirely around the toggle switch lever 62 and thus define one continuous convex surface.

As illustrated in FIG. 4, the convex surfaces 86 may extend radially about a common center point "C," thus defining an overall diameter "D." The diameter D may vary. For example, in some embodiments the diameter D may be 8.5 mm, or may be between 8 mm-9 mm. Other embodiments may include various other sizes or ranges of sizes. Additionally, in some embodiments the curvature of the convex surface 86 on one side of the toggle switch lever 62 may be different than the curvature of the convex surface 86 on the other side of the toggle switch lever 62.

With continued reference to FIGS. 4-6, the convex surfaces 86 are spaced from the concave surfaces 82 by a predetermined gap 90 (FIGS. 5 and 6) within which the toggle switch lever 62 rocks. In some embodiments, the concave surfaces 82 and the convex surfaces 86 may be spaced from one another by the same predetermined gap 90 along an entirety of the concave surfaces 82 of the bezel 22. As illustrated in FIG. 4, the convex surfaces 86 may extend upwardly extend past the concave surfaces 82. During rocking of the toggle switch lever 62, the convex surfaces 86 rotate and slide adjacent the concave surfaces 82. In some embodiments the predetermined gap 90 is less than or equal to 0.2 mm. In other embodiments, the predetermined gap 90 is less than or equal to 0.3 mm. Other embodiments include different values and ranges. The size of the predetermined gap 90 may be kept small enough, for example, such that any amount of water that enters the predetermined gap 90 between the bezel 22 and the toggle switch lever 62 is limited. Even if ice is formed in cold weather conditions within the predetermined gap 90 (for example due to freezing rain conditions), the ice will be thin and thus easy to break either within the predetermined gap 90 itself or directly above the predetermined gap 90 by simply rocking the toggle switch lever 62. In particular, it has been found that a predetermined gap 90 of no greater than 0.3 mm works well to accomplish this goal. Additionally, the rounded profile of the toggle switch lever 62 at the convex surfaces 86, in combination with the nearby concave surfaces 82, helps to force ice within the predetermined gap 90 to slide upwardly and away from the bezel opening 70 when the toggle switch lever 62 is rocked.

With reference to FIGS. 4 and 6, the bezel 22 also includes first sloped surfaces 94 and second sloped surfaces 98 on opposite sides of the bezel opening 70 that also define part of the bezel opening 70. The first sloped surfaces 94 may extend entirely around the bezel opening 70, thus forming one continuous sloped surface. Similarly, the second sloped surfaces 98 may extend entirely around the bezel opening 70, thus forming one continuous sloped surface. In the illustrated embodiment, the first sloped surfaces 94 are located directly adjacent and above the concave surfaces 82 of the bezel 22, and the second sloped surfaces 98 are located directly adjacent and above the first sloped surfaces 94. As illustrated in FIG. 6, each of the first sloped surfaces 94 extends between a first edge 102 and a second edge 106, and each of the second sloped surfaces 98 extends between the first edge 102 and a third edge 110. The second edge 106 defines an upper boundary of the concave surface 82 of the bezel 22 as well as an upper boundary of the predetermined gap 90, and the third edge 110 defines an upper boundary of the bezel opening 70 overall.

The first and second sloped surfaces 94, 98 are arranged such that the bezel opening 70 is larger at the third edge 110 than at the first edge 102, and is larger at the first edge 102 than at the second edge 106. With reference to FIG. 4, the toggle switch lever 62 may define a neutral axis 114 when the toggle switch lever 62 is not rocked and is in a natural, default position as illustrated in FIG. 4. In some embodiments, the toggle switch lever 62 may be naturally biased to the default position. The neutral axis 114 passes centrally through the bezel opening 70 and centrally through the toggle switch lever 62, projecting out centrally along a top of the first portion 74. In the illustrated embodiment the neutral axis 114 divides the toggle switch lever 62 in half. The first sloped surfaces 94 are angled at an oblique angle A1, A2 respectively relative to the neutral axis 114. In the illustrated embodiment, the oblique angles A1 and A2 are each approximately 25 degrees, although in other embodiments the angle A1 and/or A2 may be between 20-30 degrees, or may a value located outside this range. As seen in FIG. 4, the second sloped surfaces 98 are sloped at a different angle than A1 (for example an angle greater than A1).

In the illustrated embodiment both the first sloped surfaces 94 and the second sloped surfaces 98 are each planar surfaces along at least a portion of the surface. In some embodiments, one or more regions of the first and second sloped surfaces 94, 98 may be conical, as opposed to planar, or may have other shapes than that illustrated (for example may be convex, concave, and the like). Additionally, the bezel 22 may include a plurality of differently sloped surfaces (for example different planar surfaces) linked to one another and extending around the bezel opening 70. In some embodiments the remote speaker microphone 10 may include only a single sloped surface, for example that extends entirely around the bezel opening 70 and extends from the second edge 106 to the third edge 110.

With reference to FIGS. 4-10, the remote speaker microphone 10 includes an ice crushing region 118 that is defined by the bezel 22 (for example the concave surfaces 82 and the first and second sloped surfaces 94, 98), the bezel opening 70 (for example the predetermined gap 90 that forms part of the bezel opening 70), and the toggle switch lever 62 (for example the convex surfaces 86 as well as the first portion 74 of the toggle switch lever 62).

Figure 7:
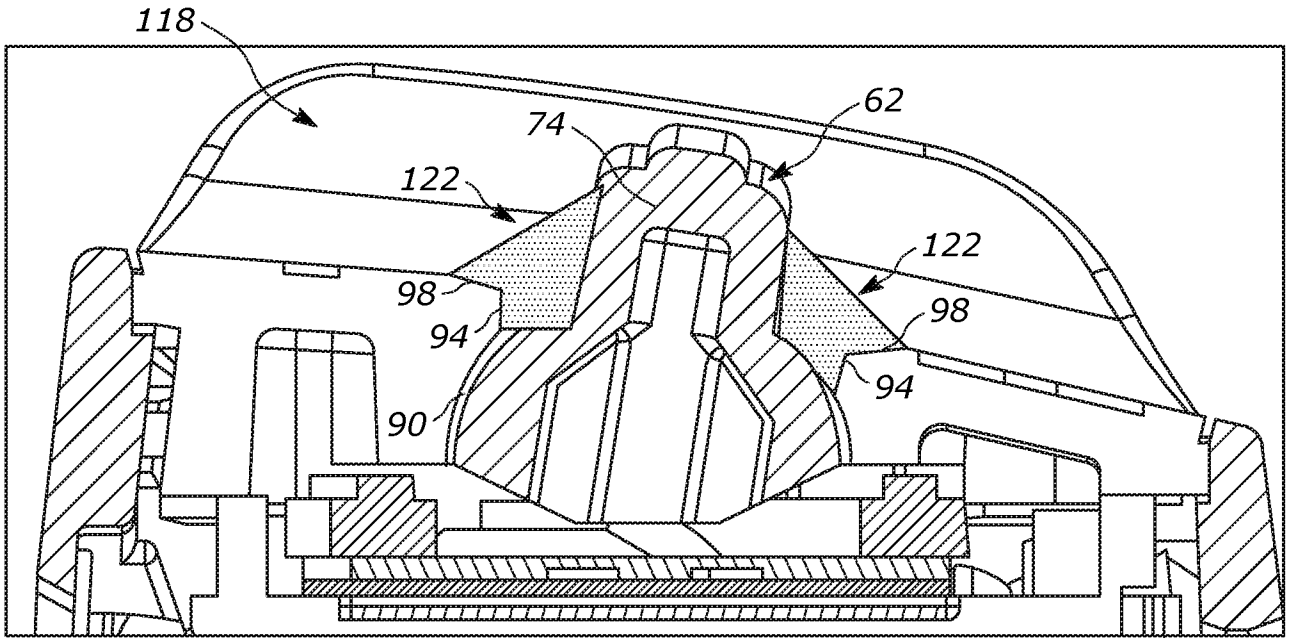
FIG. 7 is a schematic view of the toggle switch lever, illustrating a condition in which ice has formed on the toggle switch lever.

During cold weather conditions (for example, during freezing rain conditions), and as illustrated in FIG. 7, ice chunks 122 may begin to form between the first and second sloped surfaces 94, 98 and the upper, first portion 74 of the toggle switch lever 62. Some ice may additionally begin to form in the predetermined gap 90 to the left or right of the toggle switch lever 62 in FIG. 7.

Figure 8:
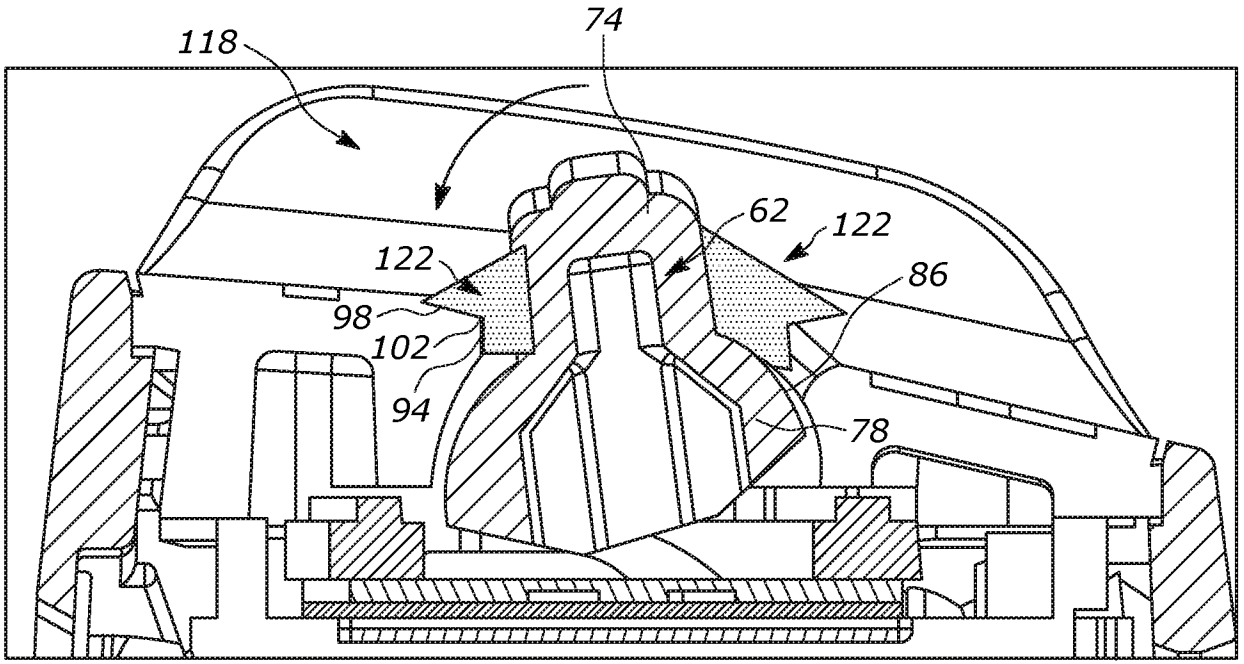
FIG. 8 is a schematic view of the toggle switch lever, illustrating a condition in which the toggle switch lever has been rocked in a first direction and a portion of the ice has been crushed.

As illustrated in FIG. 8, to remove the ice the toggle switch lever 62 is first rocked in one direction (for example to the left in FIG. 8). This movement may automatically crush and breaks any ice that has formed in the predetermined gap 90 to the left of the toggle switch lever 62. This movement additionally crushes and breaks the ice chunk 122 to the left of the toggle switch lever 62. The crushing of the ice chunk 122 is facilitated by the positioning of the first and second sloped surfaces 94, 98, as well as the first portion 74 of the toggle switch lever 62. For example, as illustrated in FIG. 8, when the toggle switch lever 62 is rocked, the ice chunk 122 becomes trapped between the first and second sloped surfaces 94, 98 and the first portion 74. The first edge 102 that defines a boundary between the first and second sloped surfaces 94, 98 may further facilitate this crushing action.

With continued reference to FIG. 8, the movement of the toggle switch lever 62 to the left additionally raises the opposite ice chunk 122 to the right of the toggle switch lever 62. This raising action is facilitated by the rotation and movement of the convex surface 86 of the second portion 78 of the toggle switch lever 62.

Figure 9:
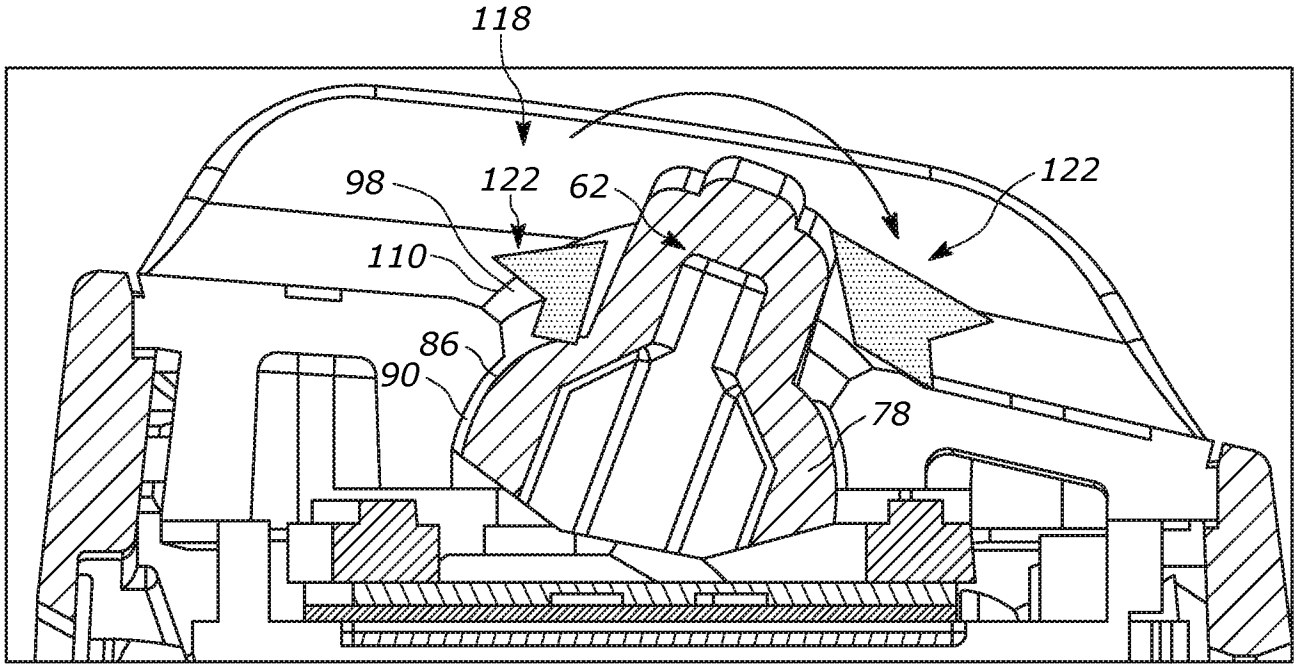
FIG. 9 is a schematic view of the toggle switch lever, illustrating a condition in which the toggle switch lever has been rocked in a second, opposite direction and a portion of the ice has been lifted and sheared off.

With reference to FIG. 9, the toggle switch lever 62 may then be rocked back in the opposite direction (to the right in FIG. 9). This movement lifts the ice chunk 122 to the left of the toggle switch lever 62. This lifting action is facilitated by the convex surface 86 of the second portion 78 of the toggle switch lever 62. This movement of the toggle switch lever 62 also causes the opposite ice chunk 122 on the right side of the toggle switch lever 62 (which has already been lifted), to be sheared off. For example, the ice chunk 122 may be pressed against the second sloped surface 98, or against the upper, third edge 110, and may shear off completely. In some embodiments this movement may additionally crush any ice formed in the predetermined gap 90 to the right of the toggle switch lever 62.

Figure 10:
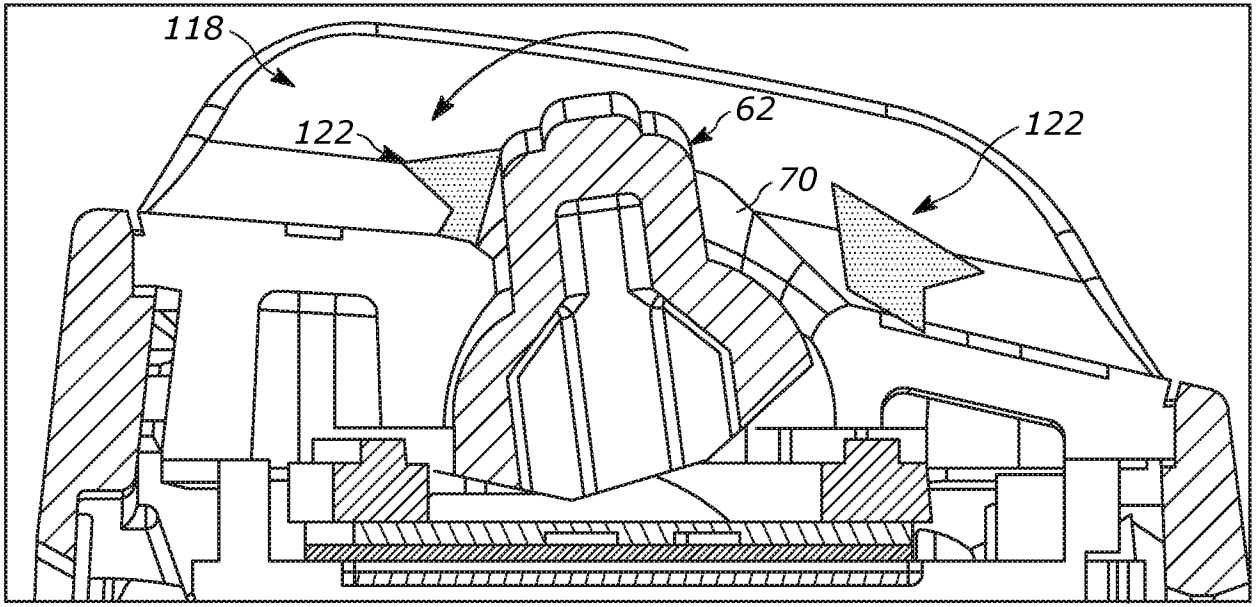
FIG. 10 is a schematic view of the toggle switch lever, illustrating a condition in which the toggle switch lever has been rocked back in the first direction, and a portion of the ice has been sheared off.

With reference to FIG. 10, the toggle switch lever 62 may then be rocked back again to the left, and the ice chunk 122 to the left of the toggle switch lever 62 may be sheared off in a similar manner. In some embodiments the rocking movements in FIG. 7-10 may be repeated two or three times or more to remove all of the ice that has accumulated within or adjacent the bezel opening 70, although at times only one set of movements may be sufficient.

The arrangement of the toggle switch lever 62 described above, as well as the ice crushing region 118 described above, provide benefits, particularly when the remote speaker microphone 10 is used as a public safety communication device on the exterior of a garment that is subject to cold weather conditions. For example, the remote speaker microphone 10 may be used by a firefighter, police office, or other public safety official, and may be worn on the exterior of the official's outfit or uniform, for example around the shoulder. In this position, the remote speaker microphone 10 may be subject to rain, freezing rain, snow, and/or ice. Thus, having an ice crushing region 118 allows the official to quickly and easily remove any build-up of ice on the remote speaker microphone 10, so that the remote speaker microphone 10 may be used for public safety purposes.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A remote speaker microphone comprising:

a housing having a bezel defining an outer surface;

a toggle switch lever configured to rock back and forth relative to the bezel; and a bezel opening through which the toggle switch lever extends at the outer surface, the bezel and the toggle switch lever defining a predetermined gap within the bezel opening and within which the toggle switch lever rocks, wherein the bezel, the bezel opening, and the toggle switch lever together form an ice crushing region in response to rocking the toggle switch lever;

wherein the bezel opening is a through opening extending through the bezel, wherein the bezel includes a concave surface that defines a portion of the through opening, and wherein the toggle switch lever includes a convex surface spaced by the predetermined gap from the concave surface of the bezel along an entirety of the concave surface, such that the predetermined gap is an open, unfilled gap along the entirety of the concave surface;

wherein the toggle switch lever defines a neutral axis when the toggle switch lever is not rocked and is in a natural, default position, wherein the neutral axis passes centrally through the bezel opening and passes centrally through the toggle switch lever, wherein the bezel includes a first sloped surface and a second sloped surface extending from the first sloped surface, wherein the first and second sloped surfaces are sloped at different angles relative to one another, and are each sloped at an oblique angle relative to the neutral axis.

2. The remote speaker microphone of claim 1, wherein the predetermined gap is between 0.2 mm-0.3 mm and forms part of the ice crushing region.

3. The remote speaker microphone of claim 1, wherein the toggle switch lever includes a first portion disposed outside of and exterior to the through opening, the first portion configured to be physically contacted and rocked by a user, the toggle switch lever further having a second portion disposed within the through opening, wherein the second portion is configured to rock with the first portion.

4. The remote speaker microphone of claim 1, wherein the convex surface of the toggle switch lever is configured to rotate and slide adjacent the concave surface of the bezel when the toggle switch lever is rocked.

5. The remote speaker microphone of claim 1, wherein a portion the convex surface of the toggle switch lever extends past the concave surface of the bezel.

6. The remote speaker microphone of claim 1, wherein the first sloped surface is directly adjacent the concave surface of the bezel.

7. The remote speaker microphone of claim 1, wherein the first sloped surface extends between a first edge and a second edge of the bezel, wherein the second edge is disposed between the first edge and the concave surface of the bezel, and wherein the first sloped surface is angled such that the bezel opening is larger at the first edge than at the second edge.

8. The remote speaker microphone of claim 7, wherein the first sloped surface forms part of the ice crushing region.

9. The remote speaker microphone of claim 1, wherein the first and second sloped surfaces form part of the ice crushing region.

10. The remote speaker microphone of claim 1, wherein the first and second sloped surfaces are each planar.

11. The remote speaker microphone of claim 1, wherein the first sloped surface is planar.

12. The remote speaker microphone of claim 1, wherein the first sloped surface extends entirely around the bezel opening.

13. The remote speaker microphone of claim 1, further comprising a toggle support element disposed interior to the bezel, and a keypad and flex element disposed interior to the toggle support element, wherein the keypad is coupled to the flex element with adhesive.

14. The remote speaker microphone of claim 13, wherein a portion of the toggle switch lever is configured to press against the keypad when the toggle switch lever is rocked.

15. The remote speaker microphone of claim 13, wherein the bezel, the toggle switch lever, the toggle support element, and the keypad are each part of a top module of the remote speaker microphone, wherein the toggle switch lever is exposed to an environment outside of the remote speaker microphone, and wherein the top module is a water-sealed sub-assembly of the remote speaker microphone.

16. The remote speaker microphone of claim 1, wherein the convex surface is configured to be spaced by the predetermined gap from the concave surface of the bezel along the entirety of the concave surface at all times.

17. The remote speaker microphone of claim 1, wherein the concave surface is one continuous concave surface.

18. A remote speaker microphone comprising:

a housing having a bezel defining an outer surface;

a toggle switch lever configured to rock back and forth relative to the bezel; and a bezel opening through which the toggle switch lever extends at the outer surface, the bezel and the toggle switch lever defining a predetermined gap within the bezel opening and within which the toggle switch lever rocks, wherein the bezel includes a first sloped surface that defines a portion of the bezel opening and a second sloped surface extending from the first sloped surface that also defines a portion of the bezel opening, wherein the first and second sloped surfaces are sloped at different angles relative to one another, and wherein the first sloped surface is disposed between the concave surface and the second sloped surface, wherein the first sloped surface extends between a first edge and a second edge of the bezel, and wherein the second sloped surface extends between the first edge and a third edge of the bezel, wherein the bezel opening is larger at the third edge than at the first edge, and is larger at the first edge than at the second edge.

19. The remote speaker microphone of claim 18, wherein both the first sloped surface and the second sloped surface each extend entirely around the bezel opening.

20. A remote speaker microphone comprising:

a housing having a bezel defining an outer surface;

a toggle switch lever configured to rock back and forth relative to the bezel; and a bezel opening through which the toggle switch lever extends at the outer surface, the bezel and the toggle switch lever defining a predetermined gap within the bezel opening and within which the toggle switch lever rocks, wherein the bezel, the bezel opening, and the toggle switch lever together form an ice crushing region in response to rocking the toggle switch lever;

wherein the bezel opening is a through opening extending through the bezel, wherein the bezel includes a concave surface that defines a portion of the through opening, and wherein the toggle switch lever includes a convex surface spaced by the predetermined gap from the concave surface of the bezel along an entirety of the concave surface, such that the predetermined gap is an open, unfilled gap along the entirety of the concave surface;

wherein the predetermined gap is between 0.2 mm-0.3 mm and forms part of the ice crushing region.

* * * * *